US010932049B2

(12) United States Patent
Zhou et al.

(10) Patent No.: US 10,932,049 B2
(45) Date of Patent: Feb. 23, 2021

(54) SOUNDING DEVICE

(71) Applicant: AAC Technologies Pte. Ltd., Singapore (SG)

(72) Inventors: Jiasheng Zhou, Shenzhen (CN); Long Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/529,732

(22) Filed: Aug. 1, 2019

(65) Prior Publication Data

US 2020/0059726 A1 Feb. 20, 2020

(30) Foreign Application Priority Data

Aug. 14, 2018 (CN) ..... 201821304355.X

(51) Int. Cl.

| | |
|---|---|
| ***H04R 9/02*** | (2006.01) |
| ***H01F 7/08*** | (2006.01) |
| ***H04R 9/06*** | (2006.01) |
| ***H01F 7/126*** | (2006.01) |

(52) U.S. Cl.

CPC ..... *H04R 9/025* (2013.01); *H01F 7/081* (2013.01); *H01F 7/126* (2013.01); *H04R 9/06* (2013.01); *H04R 2400/11* (2013.01); *H04R 2499/11* (2013.01)

(58) Field of Classification Search

None

See application file for complete search history.

(56) References Cited

U.S. PATENT DOCUMENTS

2019/0182601 A1* 6/2019 Takeda ..... H02K 33/16

FOREIGN PATENT DOCUMENTS

CN 108322870 * 7/2018

* cited by examiner

*Primary Examiner* — Tuan D Nguyen

(74) *Attorney, Agent, or Firm* — W&G Law Group LLP

(57) ABSTRACT

A sounding device includes a holder, a magnetic circuit unit, and an elastic sheet fixing the magnetic circuit unit to the holder. The magnetic circuit unit includes a yoke, a main magnet fixed to the yoke, at least two auxiliary magnets disposed around two opposite sides of the main magnet, and an upper clamping plate respectively covering and fixed to the auxiliary magnets. One end of the elastic sheet is fixed to the holder, and the other end of the elastic sheet is fixed to the upper clamping plate.

4 Claims, 3 Drawing Sheets

SOUNDING DEVICE

TECHNICAL FIELD

The present disclosure relates to the field of electroacoustic transformation, and in particular, to a sounding device applied to portable electronic products.

BACKGROUND

With the advent of the mobile Internet era, the number of smart mobile devices is on the rise. Among the numerous mobile devices, mobile phones are undoubtedly the most common and portable mobile terminal device. At present, the mobile phones have a variety of functions, one of which is the high-quality music function. Therefore, sounding devices for playing sound have been widely used in the current smart mobile devices.

In the related art, the sounding device includes a holder, a vibration system fixed to the holder, a magnetic circuit unit, and an elastic sheet fixing the magnetic circuit unit to the holder. The magnetic circuit unit includes a yoke bottom wall, a yoke side wall bending and extending from the yoke bottom wall, and a magnet fixed to the yoke bottom wall. The magnet and the yoke side wall are spaced apart from each other to form a magnetic gap.

However, in the sounding device of the related art, the elastic sheet is fixed to the yoke side wall to fix the magnetic circuit unit to the holder. Since the yoke side wall is necessary to the structure, the magnetic circuit unit can only be designed as a unit magnetic circuit structure of the magnet, which limits the improvement of the sensitivity and vibration amplitude of the sounding device, namely, limits the improvement of its acoustic performance.

Therefore, it is necessary to provide a novel sounding device so as to solve the above technical problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding portions throughout the several views.

DESCRIPTION OF EMBODIMENTS

The present invention will be further illustrated with reference to the accompanying drawings and the embodiments.

Figure 1:
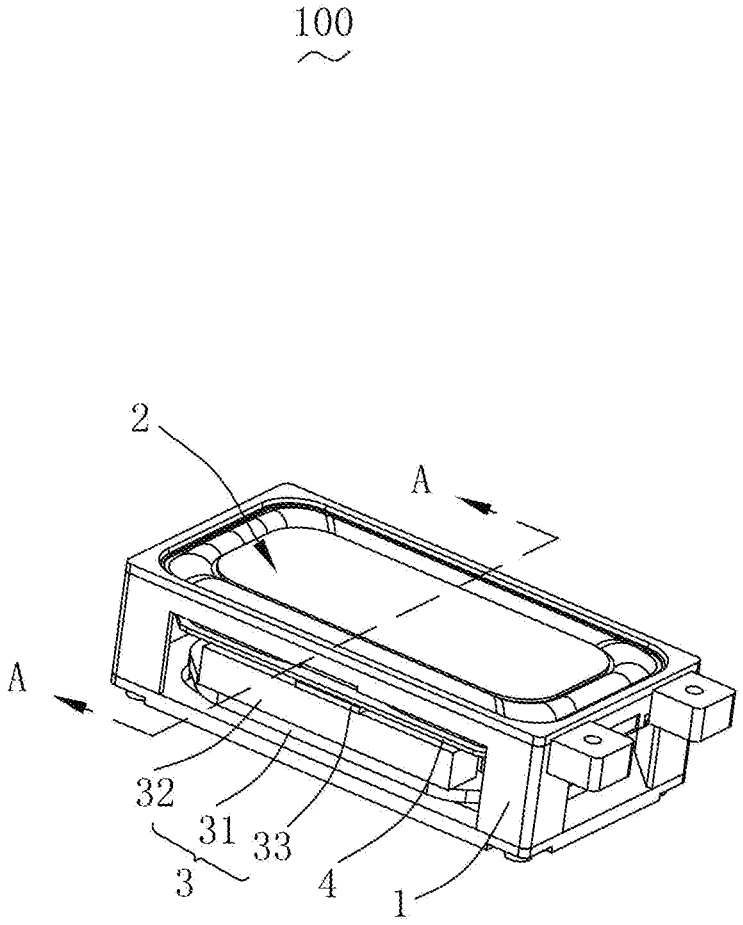
FIG. 1 is a perspective structural schematic diagram of a sounding device according to the present disclosure.

Referring to FIG. 1, the present disclosure provides a sounding device 100, including a holder 1, a vibration system 2, a magnetic circuit unit 3, and an elastic sheet 4.

The vibration system 2 is fixed to the holder 1. The magnetic circuit unit 3 is fixedly supported on the holder 1 through the elastic sheet 4. The magnetic circuit unit 3 produces a magnetic field to drive the vibration system 2 to vibrate to produce sound.

Figure 2:
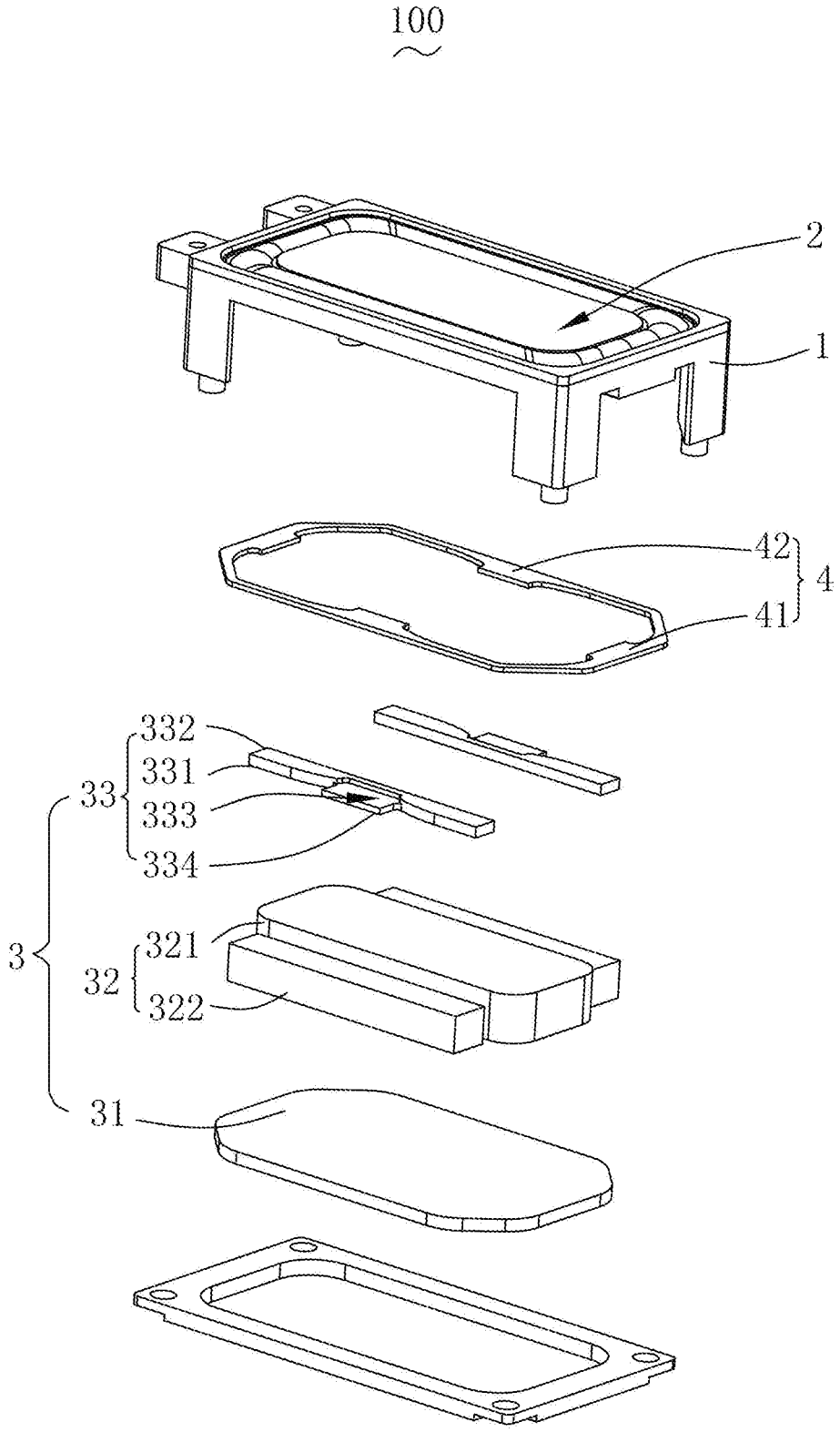
FIG. 2 is a perspective exploded structural schematic diagram of the sounding device according to the present disclosure.
Figure 3:
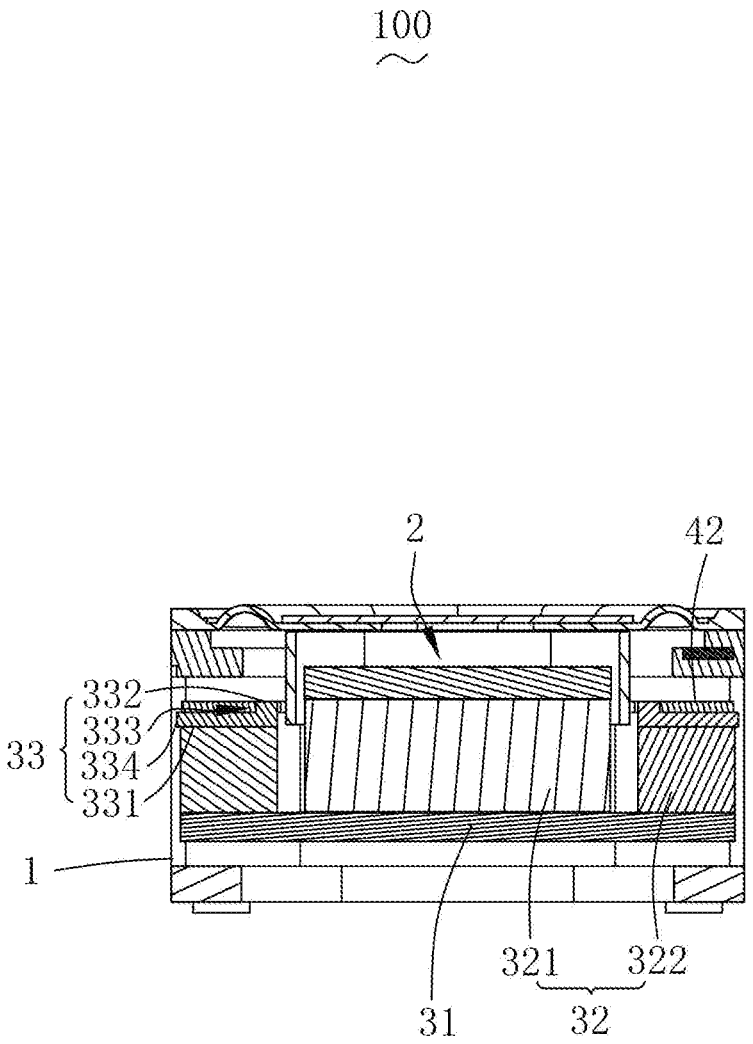
FIG. 3 is a cross-sectional diagram of the sounding device as shown in FIG. 1 taken along line A-A.

Referring to FIGS. 2-3, the magnetic circuit unit 3 includes a yoke 31, a magnet 32 fixed to the yoke 31, and an upper clamping plate 33.

The magnet 32 includes a main magnet 321 fixed to the yoke 31 and at least two auxiliary magnets 322 disposed around two opposite sides of the main magnet 321. The two auxiliary magnets 322 form a magnetic gap (not shown) with the main magnet 321. Such a three magnetic circuit structure effectively improves the driving force of the magnetic circuit unit 3, thus effectively improving the sensitivity and vibration amplitude of the sounding device 100, namely, effectively improving the acoustic performance of the sounding device 100.

The upper clamping plate 33 includes a bottom surface 331 fixed to the auxiliary magnet 322, a top surface 332 opposite to the bottom surface 331, and a recess 333 formed by recessing to a direction towards the bottom surface. The bottom surface 331 covers and is fixed to the auxiliary magnet 322.

The elastic sheet 4 includes a ring-shaped body portion 41 fixed to the holder and a fixing portion 42 extending from the body portion 41 along a direction close to the upper clamping plate 33, and the fixing portion 42 is fixed to the upper clamping plate 33. Definitely, the structure of the elastic sheet 4 is not limited to the ring-shaped integral structure, but can also have multiple split structures, which are all feasible.

In this embodiment, one end of the elastic sheet 4 is fixed to the holder 1, and the other end of the elastic sheet 4 is fixed to the upper clamping plate 33.

Specifically, the fixing portion 42 is received in and fixed to the recess 333.

More optionally, the recess depth of the recess 333 is equal to the thickness of the fixing portion 42. The structure is configured such that the overall thickness of the magnetic circuit unit 3 will not be increased when the elastic sheet 4 fixedly supports the magnetic circuit unit 3, which is conducive to the lightweight design of the sounding device 100.

In this embodiment, the upper clamping plate 33 further includes an extending wall 334 protruding towards the holder 1 and extending from a position corresponding to the recess 333 on a side of the upper clamping plate 333 close to the holder 1, and the fixing portion 42 is at least partially supported on the extending wall 334. The extending wall 334 further enhances the fixing strength and stability of the elastic sheet 4 and the upper clamping plate 33.

Compared with the related art, the magnetic circuit unit in the present disclosure includes a yoke, a main magnet fixed to the yoke, at least two auxiliary magnets disposed around two opposite sides of the main magnet, and an upper clamping plate covering and fixed to the auxiliary magnets respectively. One end of the elastic sheet is fixed to the holder, and the other end of the elastic sheet is fixed to the upper clamping plate. In the above structure, the elastic sheet does not directly contact the magnetic circuit unit, thus avoiding the influence on the sensitivity of the sounding device. Meanwhile, the structure is a three magnetic circuit structure, which can improve the driving force of the magnetic circuit unit, thereby effectively enhancing the vibration amplitude, namely, effectively improving the acoustic performance of the sounding device.

The above are merely the embodiments of the present disclosure, and it should be noted that those skilled in the art can also make improvements, without departing from the creative conception of the present disclosure, which all shall fall within the scope of the present disclosure.

What is claimed is:

1. A sounding device, comprising:

a holder;

a magnetic circuit unit comprising a yoke, a main magnet fixed to the yoke, at least two auxiliary magnets disposed around two opposite sides of the main magnet, and an upper clamping plate respectively covering and fixed to the at least two auxiliary magnets; and an elastic sheet fixing the magnetic circuit unit to the holder, one end of the elastic sheet being fixed to the holder, and the other end of the elastic sheet being fixed to the upper clamping plate; and wherein the elastic sheet comprises a ring-shaped body portion fixed to the holder and a fixing portion extending from the body portion along a direction facing toward the upper clamping plate, and the fixing portion is fixed to the upper clamping plate.

2. The sounding device as described in claim 1, wherein the upper clamping plate comprises a bottom surface fixed to one of the at least two auxiliary magnets, a top surface opposite to the bottom surface, and a recess formed by recessing from the top surface facing toward the bottom surface, and the fixing portion is received in and fixed to the recess.

3. The sounding device as described in claim 2, wherein a recess depth of the recess is equal to a thickness of the fixing portion.

4. The sounding device as described in claim 2, wherein the upper clamping plate further comprises an extending wall protruding and extending towards the holder from a position, corresponding to the recess, on a side of the upper clamping plate close to the holder, and the fixing portion is at least partially supported on the extending wall.

* * * * *